US006526929B2

(12) United States Patent
Lehmann

(10) Patent No.: US 6,526,929 B2
(45) Date of Patent: Mar. 4, 2003

(54) DEVICE FOR RELATIVE ANGULAR ADJUSTMENT BETWEEN TWO DRIVE-CONNECTED ELEMENTS ROTATING AT THE SAME ROTATIONAL SPEED

(75) Inventor: Kai Lehmann, Ludwigsfelde (DE)

(73) Assignee: DaimlerChrysler, Stuttgart (DE)

( * ) Notice: Subject to any disclaimer, the term of this patent is extended or adjusted under 35 U.S.C. 154(b) by 0 days.

(21) Appl. No.: 09/912,979

(22) Filed: Jul. 25, 2001

(65) Prior Publication Data

US 2002/0020376 A1 Feb. 21, 2002

(30) Foreign Application Priority Data

Jul. 26, 2000 (DE) ..... 100 36 275

(51) Int. Cl.[7] ..... F01L 1/34

(52) U.S. Cl. ..... 123/90.17; 123/90.15; 123/90.16; 123/90.27; 123/90.3; 123/90.31; 464/1; 464/2; 464/160; 74/568 R

(58) Field of Search ..... 123/90.17, 90.15, 123/90.11, 90.3

(56) References Cited

U.S. PATENT DOCUMENTS

| | | | | | |
|---|---|---|---|---|---|
| 3,978,829 | A | * | 9/1976 | Takahashi et al. | 123/90.15 |
| 4,895,113 | A | * | 1/1990 | Speier et al. | 123/90.17 |
| 6,129,061 | A | * | 10/2000 | Okuda et al. | 123/90.17 |
| 6,257,186 | B1 | * | 7/2001 | Heer | 123/90.17 |

FOREIGN PATENT DOCUMENTS

| | | |
|---|---|---|
| DE | 196 54 926 | 11/1997 |

* cited by examiner

*Primary Examiner*—Thomas Denion
*Assistant Examiner*—Ching Chang
(74) *Attorney, Agent, or Firm*—Kenyon & Kenyon

(57) ABSTRACT

A device for relative angular adjustment between two drive-connected elements rotating at the same rotational speed, in particular between a chain wheel and a camshaft of an internal combustion engine, includes, as an actuating drive, an electrically commutated electric motor with, as coil part, a stator arranged fixedly relative to the housing.

13 Claims, 1 Drawing Sheet

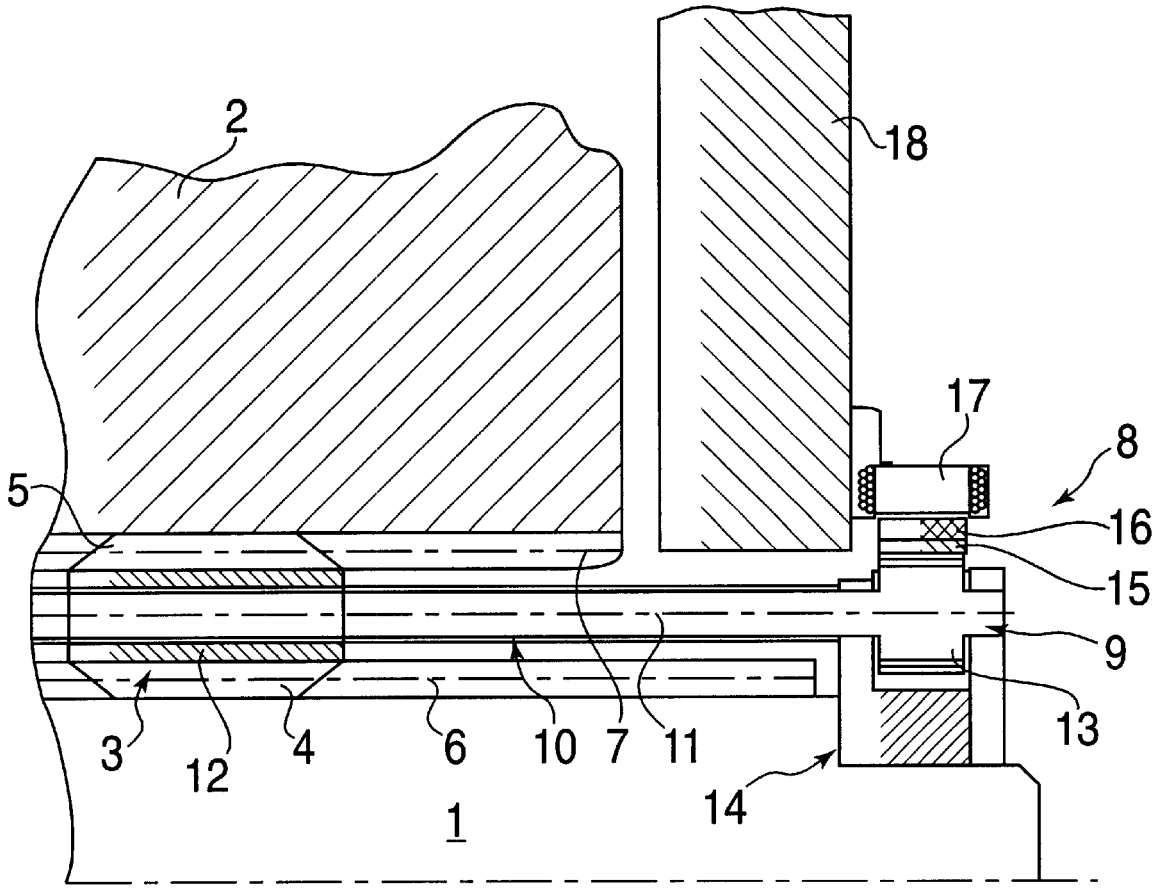
2
18
17
8
5
16
15
9
13
3
12
4
6
10
7
11
14
1

DEVICE FOR RELATIVE ANGULAR ADJUSTMENT BETWEEN TWO DRIVE-CONNECTED ELEMENTS ROTATING AT THE SAME ROTATIONAL SPEED

FIELD OF THE INVENTION

The present invention relates to a device for relative angular adjustment between two drive-connected elements rotating at the same rotational speed.

BACKGROUND INFORMATION

Devices of the type mentioned above are described, for example, in German Published Patent Application No. 196 54 926 and are provided for the relative angular adjustment of the camshaft in relation to the crankshaft driving the latter, at the transition between the camshaft-side chain wheel, rotating at the same rotational speed as the camshaft, and the camshaft, as elements adjustable in relation to one another in terms of their relative angular position. Angular adjustment occurs by an axially displaceable transmission member which carries a helical toothing radially on the inside and radially on the outside, the radially inner and the radially outer helical toothings being set in opposite, so that, during axial displacement of the transmission member, the elements connected via the transmission member are adjusted in relation to one another in terms of their relative angular position. The displacement of the transmission member occurs via a hydraulically loadable actuating piston, in the supply path of which is located a control slide acted upon via a solenoid valve.

Devices of this type have proved appropriate in practice and make it possible to apply the necessary actuating forces by connection to the oil circuit of the internal combustion engine. On the other hand, however, their mechanical construction is relatively complicated, and they also require electrical activation for the actuating magnets in addition to connection to the oil circuit of the internal combustion engine.

SUMMARY

It is an object of the present invention to provide a device for relative angular adjustment between two drive-connected elements rotating at the same rotational speed, which has a simplified construction and a reduced space requirement.

The above and other beneficial objects of the present invention are achieved by providing a device as described herein. In this case, use is made of an electronically commutated electric motor as an actuating drive, of which the stator forming the coil part is fixed in position for support, so that simple line feeds are provided, and of which the rotor, as a part fitted with permanent magnets, is assigned to one of the rotating elements and may be carried via the latter. This configuration avoids interfaces between moved and non-moved parts with regard to control and electrical power supply, and, as regards the rotor, it makes it possible to have a simple construction which is insensitive to rotational speed and, in conjunction with a corresponding gear connection to the transmission member, also makes it possible to implement high transmission ratios, so that comparatively low drive powers are required.

When the device according to the present invention is used on a camshaft adjuster for internal combustion engines, in which the transmission member is located between the chain wheel driven by the crankshaft and concentric to the camshaft and the camshaft, it may be beneficial to support the rotor against the camshaft, this support including, for example, a gear connection to the transmission member, so that a simple construction is obtained, the rotor, as a ring gear, being supported on planet wheels which are concentric to the camshaft and which are mounted in a carrying housing supported on the camshaft and are continued in coaxial spindles which engage into the transmission member and via which the transmission member may be adjusted axially.

The transmission member may be configured as a sliding block which includes a helical toothing in each case radially on the outside and radially on the inside, the two helical toothings being set in opposition and meshing with corresponding helical toothings of the chain wheel and of the camshaft, so that an axial adjustment of the transmission member configured as a sliding block is accompanied by a rotation of the chain wheel and of the camshaft in mutually opposite directions of rotation, this rotation resulting in the intended angular adjustment.

In a solution of this type, an axial adjustment of the sliding block is possible, e.g., by a rotary drive via the spindle, but not by axial forces introduced via the helical toothings, so as to afford a self-locking connection, by which the chain wheel and the camshaft are connected fixedly in terms of rotation relative to one another in a concentric position, as long as a desired angular adjustment is not performed via the drive of the spindle. Accordingly, the carrying housing for the support of the spindles or of the planet wheels in relation to the camshaft is fixed in a circumferential direction, relative to the camshaft, via the spindles engaging into the sliding blocks, as long as the rotor is not driven at a rotational frequency deviating from that of the camshaft.

A spindle drive of this type for the transmission members makes it possible to have very high transmission ratios due to the choice of the spindle thread and because of the relatively large diameter of the rotor which meshes via the ring gear with the gearwheels mounted in the carrying housing and arranged in a planet-like manner in relation to the camshaft.

If a relative angular adjustment between the two elements, i.e., the chain wheel and the camshaft, is to be performed via the actuating drive, the rotating field of the stator is excited at a frequency different from the rotational frequency of the camshaft. The difference between the rotational frequency of the camshaft and the exciting frequency of the stator corresponds to the resulting rotational frequency of the rotor. At an exciting frequency of the stator corresponding to the rotational frequency of the camshaft, therefore, the rotor rotates synchronously with the camshaft, so that, on the assumption that the stator is at the corresponding exciting frequency, the transmission member is also held via the spindles in an axial position assigned to a given relative angular position between the chain wheel and the camshaft.

Instead of a gear system of the abovementioned type, it is also possible to provide between the chain wheel and the camshaft a worm drive which adjusts the chain wheel and the camshaft in terms of their angular position when the actuating drive is activated correspondingly.

BRIEF DESCRIPTION OF THE DRAWINGS

FIG. 1 is a schematic partial cross-sectional view of a camshaft of an internal combustion engine having an adjusting device according to the present invention.

DETAILED DESCRIPTION

In the schematic illustration of the camshaft drive of an internal combustion engine, shown in partial cross-section, 1 designates the camshaft which, in the drive to the crankshaft, not illustrated, of the internal combustion engine, is assigned a chain wheel 2 which drives the camshaft 1 by a transmission member 3, so that the chain wheel 2 and the camshaft 1 have the same rotational speed. The chain wheel 2, which on its circumference carries the chain and is provided with a corresponding chain toothing, is arranged concentrically to the camshaft 1 and surrounds the latter, the transmission member 3 located between the chain wheel 2 and the camshaft 1 being designed as an axially displaceable sliding body which may also be configured as an annular body surrounding the camshaft 2 and which is in engagement, via helical toothings 4 and 5 set at an angle to one another and provided radially on the inside and radially on the outside, with corresponding counter-toothings 6 and 7 of the camshaft 1 and of the chain wheel 2, so that, during axial displacement of the transmission member 3, the chain wheel 2 and the camshaft 1 are changed in relation to one another in terms of their relative angular position.

The axial displacement for changing the phase relationship between the chain wheel 2 and the camshaft 1 is performed via an actuating drive 8 which is connected via a gear connection 9 to the transmission member 3. The gear connection 9 includes a spindle drive 10 with a spindle 11 which runs parallel to the camshaft 1 and which engages into a threaded bush 12 of the transmission member 3 and carries, axially opposite, a gearwheel 13 which, together with the corresponding end region of the spindle 11, is mounted in a carrying housing 14 supported rotatably on the camshaft 1. The carrying housing 14 forms a two-sided mounting for the gearwheel 13, and, for example, at least three identically configured spindle drives 10 are provided over the circumference of the camshaft 1 and the carrying housing 14 is configured as an annular housing surrounding the camshaft 1. The gearwheels 13 form the radial support for a ring gear 15 which is toothed correspondingly to the gearwheels 13 acting as carrying planets and which is assigned to the rotor 16 of the actuating drive 8 which is formed as an electromotive actuating drive by an electronically commutated electric motor. The stator of the latter is designated by 17 and is attached at a fixed location, e.g., to a housing or a casing part 18 of the internal combustion engine, the stator 17 being assigned the coil part of the electric motor, so that the electrical connections are fed to a non-moved part of the electromotive drive, i.e., to the stator 17 supported fixedly relative to the housing, with the result that the rotary transmissions necessary when the coil part is assigned to the rotor, for example, via slip rings, etc., are eliminated.

The coil part assigned to the stator 17 is activated in a conventional manner, such that a rotating field is obtained, in which the motor part fitted with permanent magnets and formed by the rotor 16 rotates, a relative rotation of the rotor 16 in relation to the camshaft 1 carrying the carrying housing 14 occurring when the rotational frequency of the camshaft 1 deviates from the frequency of the rotating field in the stator 17. The difference between the rotational frequency of the camshaft 1 and the exciting frequency of the stator 17, i.e., the frequency of the rotating field in the stator 17, corresponds to the resulting rotational frequency of the rotor 16 in relation to the camshaft 1, so that the rotational speed of the spindle 11 and therefore the adjusting speed during the relative angular adjustment between the chain wheel 2 and the camshaft 1 may be controlled via the magnitude of the difference in the exciting frequency of the stator 17 from the rotational frequency of the camshaft 1.

The drive, provided according to the present invention, via an electronically commutated motor as actuating drive 8 makes it possible to have a wear-free, simple and space-saving device for relative angular adjustment between two rotating elements driven at the same rotational speed, here the chain wheel 2 and the camshaft 1, and forms a particularly favorable drive solution for a camshaft adjuster in internal combustion engines, whereas, in contrast to the example embodiment illustrated, other gear connections or actuating connections between the actuating drive 8 and the camshaft 1 and the chain wheel 2 may also be provided, such as, for example, worm-wheel systems, etc.

In conjunction with the arrangement according to the present invention, the spindle drive 10 provides a particularly simple solution allowing high transmission ratios, so that small-sized electromotive actuating drives operated at high rotational speeds may be used.

The present invention affords the general possibility of initiating in a non-contact manner, in a system rotating in relation to a reference system, translational or rotational actuating movements by an exciting frequency, deviating from the rotational frequency of the rotating system, for the stator which contains the coil system and which is fixed in relation to the reference system. The respective actuating movement is obtained in that, at an exciting frequency of the stator deviating from the rotational frequency of the rotating system, the rotor of the electromotive actuating drive including stator and rotor, the rotor belonging to the rotating system, being rotated relative to the latter and rotating together with it, rotates in relation to the rotating system at a rotational frequency corresponding to the difference between these frequencies. This rotation of the rotor in relation to the rotating system may be converted via corresponding gear connections into actuating movements, thus, for example, as explained in the example embodiment, into rotational actuating movements, or else into translational actuating movements, such as are necessary, for example, in CVT gears for setting the axial disc spacing corresponding to the respective transmission ratio. In terms of the example embodiment described, such a translational adjustment is possible via the sliding block, when the sliding block is guided appropriately, and the guide may be designed, for example, as a parallel guide codirectional with the spindle, so that the sliding block virtually forms an actuating piston driven via the spindle.

What is claimed is:

1. A device for relative angular adjustment between two drive-connected elements that are rotatable at a same rotational speed and are arranged in a drive train, comprising:

a support, the two elements being arranged at a fixed location concentrically with respect to the support;

a transmission member configured to connect the two elements, a change of position of the transmission member relative to the two elements changing a relative angular position between the two elements; and an actuating drive configured to actuate the transmission member;

wherein the actuating drive includes an electronically commutated electric motor having a stator and a rotor, the stator carrying a coil part being at a fixed location relative to the support, the rotor being assigned to one of the two elements.

2. The device according to claim 1, wherein the support includes a housing part of an internal combustion engine, one of the two elements including a camshaft of the internal combustion engine.

3. The device according to claim 1, wherein the support includes a housing part of an internal combustion engine, one of the two elements including a chain wheel driven by a crankshaft of the internal combustion engine.

4. The device according to claim 1, wherein the support includes a housing part of an internal combustion engine, a first one of the two elements including a camshaft of the internal combustion engine, a second one of the two elements including a chain wheel driven by a crankshaft of the internal combustion engine.

5. The device according to claim 4, wherein the rotor is arranged concentrically to the camshaft and the chain wheel.

6. The device according to claim 5, wherein the rotor is supported on the camshaft.

7. The device according to claim 5, wherein the rotor is supported on the chain wheel.

8. A device for relative angular adjustment between two drive-connected elements that are rotatable at a same rotational speed and are arranged in a drive train, comprising:

a support, the two elements being arranged at a fixed location concentrically with respect to the support, wherein the support includes a housing part of an internal combustion engine, a first one of the two elements including a camshaft of the internal combustion engine, a second one of the two elements including a chain wheel driven by a crankshaft of the internal combustion engine;

a transmission member configured to connect the two elements, a change of position of the transmission member relative to the two elements changing a relative angular position between the two elements; and an actuating drive configured to actuate the transmission member;

wherein the actuating drive includes an electronically commutated electric motor having a stator and a rotor, the stator carrying a coil part being at a fixed location relative to the support, the rotor being assigned to one of the two elements, wherein the rotor is arranged concentrically to the camshaft and the chain wheel and is supported on the camshaft, and wherein the rotor is assigned to a ring gear supported on gearwheels, the gearwheels being arranged in a concentric planetary arrangement relative to the camshaft.

9. A device for relative angular adjustment between two drive-connected elements that are rotatable at a same rotational speed and are arranged in a drive train, comprising:

a support, the two elements being arranged at a fixed location concentrically with respect to the support, wherein the support includes a housing part of an internal combustion engine, a first one of the two elements including a camshaft of the internal combustion engine, a second one of the two elements including a chain wheel driven by a crankshaft of the internal combustion engine;

a transmission member configured to connect the two elements, a change of position of the transmission member relative to the two elements changing a relative angular position between the two elements; and an actuating drive configured to actuate the transmission member;

wherein the actuating drive includes an electronically commutated electric motor having a stator and a rotor, the stator carrying a coil part being at a fixed location relative to the support, the rotor being assigned to one of the two elements, wherein the rotor is arranged concentrically to the camshaft and the chain wheel and is supported on the chain wheel, and wherein the rotor is assigned to a ring gear supported on gearwheels, the gearwheels being arranged in a planetary arrangement relative to the camshaft.

10. The device according to claim 8, wherein the gearwheels are assigned to a planet carrier, the planet carrier including a carrying housing mounted on the camshaft.

11. The device according to claim 9, wherein the gearwheels are assigned to a planet carrier, the planet carrier including a carrying housing mounted on the camshaft.

12. The device according to claim 10, wherein the carrying housing is rotatable relative to the camshaft, a gearwheel and an actuating spindle forming a gear connection to the transmission member supported against the camshaft and the chain wheel via opposed helical toothings.

13. The device according to claim 11, wherein the carrying housing is rotatable relative to the camshaft, a gearwheel and an actuating spindle forming a gear connection to the transmission member supported against the camshaft and the chain wheel via opposed helical toothings.

* * * * *